United States Patent [19]

Hudson

[11] 4,108,111

[45] Aug. 22, 1978

[54] DEVELOPER HOUSING

[75] Inventor: Frederick W. Hudson, West Henrietta, N.Y.

[73] Assignee: Xerox Corporation, Stamford, Conn.

[21] Appl. No.: 802,157

[22] Filed: May 31, 1977

[51] Int. Cl.[2] ..... G03G 15/08

[52] U.S. Cl. ..... 118/655; 118/653

[58] Field of Search ..... 118/654, 657, 658, 656, 118/652, 662, 653, 647, 648, 649, 650, 651, 655

[56] References Cited

U.S. PATENT DOCUMENTS

| | | | |
|---|---|---|---|
| 2,927,554 | 3/1960 | Oldenboom | 118/655 |
| 3,117,030 | 1/1964 | Jons et al. | 118/654 |
| 3,380,437 | 4/1968 | Swyler | 118/650 |
| 3,393,663 | 7/1968 | Donalies | 118/650 |
| 3,635,196 | 1/1972 | Tsilibes | 118/655 |
| 3,640,247 | 2/1972 | Mason et al. | 118/657 |
| 3,682,137 | 8/1972 | Roth, Jr. et al. | 118/654 |
| 3,685,488 | 8/1972 | Stover | 118/647 |
| 3,809,012 | 5/1974 | Delvecchio | 118/653 |
| 3,877,413 | 4/1975 | Rowell et al. | 118/647 X |
| 3,894,514 | 7/1975 | Caudill et al. | 118/655 |
| 3,906,899 | 9/1975 | Harpavat | 118/655 |
| 4,007,707 | 2/1977 | Buchan et al. | 118/647 |

*Primary Examiner*—Mervin Stein
*Assistant Examiner*—Andrew M. Falik
*Attorney, Agent, or Firm*—James J. Ralabate; John E. Beck; George J. Cannon

[57] ABSTRACT

A development system for developing latent magnetic images with magnetic toner comprises a developer housing having an upper chamber communicating through a selectively variable opening with a lower chamber, the lower chamber defining the development zone and being provided with peripheral edge seals. In operation, magnetic toner is gravity fed through the selectively variable opening to the lower chamber, filling the lower chamber to provide flood contact development of the latent magnetic image residing on a magnetizable member which is moved in a direction counter to that of gravity flow. Optional baffles are preferably included in the developer housing and above the development zone to prevent machine contamination by toner powder cloud during high speed development.

4 Claims, 5 Drawing Figures

DEVELOPER HOUSING

BACKGROUND OF THE INVENTION

This invention relates to magnetic imaging; and, more particularly, to development apparatus for applying magnetic toner to latent magnetic images.

Latent magnetic images on magnetizable imaging members are typically developed by deposition of magnetic developer material commonly referred to as magnetic toner onto the magnetizable imaging member. The developing material is attracted to the magnetizable member by magnetic fields constituting the latent magnetic image.

However, in developing latent magnetic images on a magnetizable member it is necessary to introduce the developing material within a very short distance from the latent magnetic image, typically within about 10 microns of the image, due to the short range nature of the magnetic forces associated with the latent magnetic image. Accordingly, flood contact development of latent magnetic images is generally preferred as a technique which will insure that the magnetic toner material is introduced within the short distance from a latent magnetic image to allow full, dense development.

PRIOR ART STATEMENT

Flood contact development for xerographic development is shown in U.S. Pat. Nos. 3,685,488 (FIGS. 1, 2 and 3), U.S. Pat. No. 3,380,437 (FIGS. 1–3); 3,393,663 (FIG. 2); 3,547,660 (FIGS. 1, 2 and 4); 3,641,977 (FIGS. 1–4) and in 3,682,137 (FIGS. 1 and 2). Descriptive portions of the aforementioned patents corresponding to the figures describe the xerographic developer behavior and operation of the apparatus. Flood contact development of latent magnetic images with magnetic toner is disclosed in U.S. Pat. No. 2,943,908 (FIG. 2). All of the aforementioned patents are deemed relevant only to the extent of showing flood, contact development of a latent image with toner material; except for aforementioned U.S. Pat. No. 3,685,488 (FIG. 2) illustrating a "Y" shaped relationship between toner hopper and toner development zone for continuous flow xerographic development.

However, the magnetic forces associated with latent magnetic images are much weaker than the electrostatic forces associated with latent electrostatic images utilized in xerography. Accordingly, for high speed, cyclical magnetic imaging it is essential to the production of good quality images having high contrast that the development zone, and thus the length of time in which the latent magnetic image is in contact with the magnetic toner, be selectively variable to accommodate variations in magnetic field strengths of various magnetic recording materials. Furthermore, with single component magnetic toner, in contrast to two component xerographic developer comprising carrier and toner, it is not necessary to have continuous or intermittent developer motion to maintain the triboelectric relationship between the toner and carrier.

Thus, it is desirable to have a compact tank development system for developing latent magnetic images which is capable of providing a selectively variable development zone, which has magnetic toner storage capacity for automatically replenishing toner depleted from the development zone in a simplified manner, which prevents continuous flow of toner out through the bottom of the development zone and which is capable of maintaining intimate contact between magnetic toner and the imaging member bearing the latent magnetic image throughout the entire development zone.

SUMMARY OF THE INVENTION

Objects of this invention, therefore, are to provide the aforementioned functions and advantages in a novel, compact tank development system for developing latent magnetic images with magnetic toner.

The aforementioned objects and advantages and others are realized in accordance with the practice of the present invention by a tank development system comprising a developer housing having therein a "Y" shaped relation between an upper toner supply chamber which communicates through a selectively variable opening with a lower development zone; the developer housing having side and bottom edge seals for low friction, conformable engagement with a magnetizable imaging member. For use in high speed magnetic development, the tank development system is provided with baffles above the development zone to entrap airborne toner.

BRIEF DESCRIPTION OF THE DRAWINGS

For a better understanding of the invention as well as other objects and further features thereof, references made to the following detailed disclosure of the preferred embodiments of the invention taken in conjunction with the accompanying drawings thereof, wherein.

DESCRIPTION OF THE PREFERRED EMBODIMENTS

Figure 1:
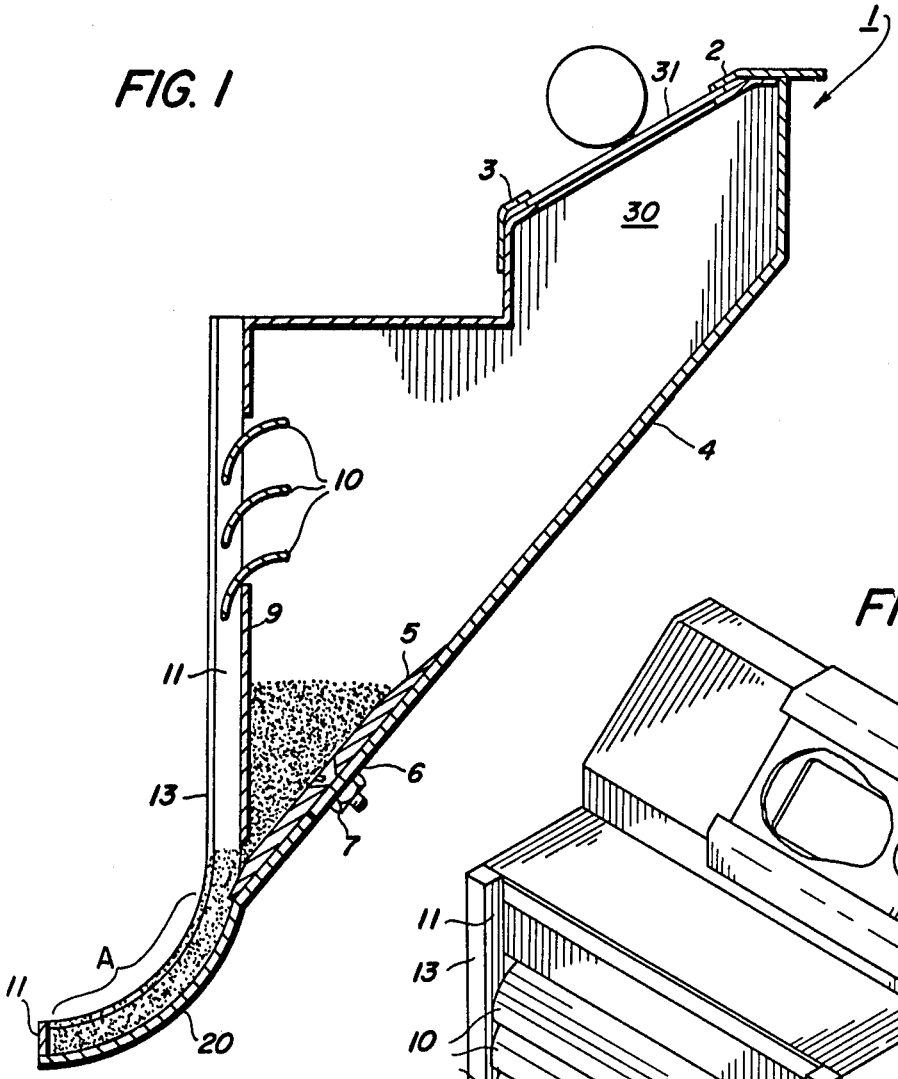
FIG. 1 is a schematic, cross-sectional side-view illustration of an embodiment of the present invention.

Referring now to FIG. 1, there is seen an embodiment of the present invention particularly preferred for development of latent magnetic images residing on magnetic webs or tape. The tank development apparatus in FIG. 1 comprises a housing 1 having an opening 30 in the uppermost wall covered by a sliding member 31 retained by flanges 2 and 3. Walls 9 and 4 of housing 1 define a toner storage or supply chamber communicating with a development zone A through an opening 8. Metering plate 5 is moveable into and out of opening 8 by movement of retention member 7 along slot 6 in wall 4. The developer housing is made of non-magnetic materials such as stainless steel to minimize interference with the latent magnetic image which is undergoing development and to minimize interference with the flowing properties of magnetic material deposited in the toner storage chamber.

Figure 2:
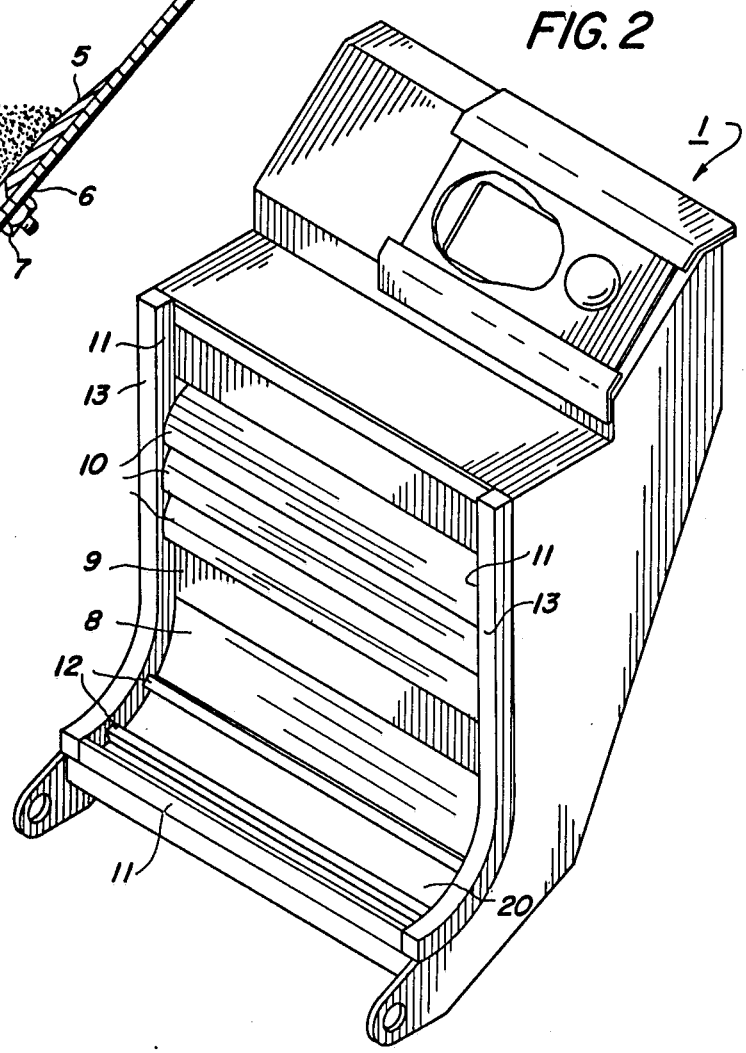
FIG. 2 is a schematic, perspective view of the embodiment of FIG. 1.

Wall 20 of housing 1 is shaped to conform to a predetermined path of travel of the magnetizable imaging member which is to be latently magnetically imaged and developed. Wall 20 may comprise a portion of either wall 9, or of wall 4, or may be a separate wall member of the developer housing. Resilient seal forming means 11 may comprise any resilient, including deformable material. Typical suitable materials include, Teflon, a trademark for DuPont tetrafluoroethylene fluorocarbon resins; soft rubber and polyvinyl chloride foam. Seal forming means 11 is affixed to walls 9 and 20 at least along the predetermined path of travel of the magnetizable imaging member which is to be developed. Resilient seal forming means 11 is affixed to walls 20 and 9 on the sides thereof opposite the toner supply chamber as can best be seen from viewing FIG. 2. Resilient seal forming means 11 is affixed along the edges of walls 20 and 9 and along the bottom of wall 20. As depicted in FIGS. 1 and 2 a low friction material is applied to the surface of resilient seal forming means 11 as surface 13. Low friction surface 13 comprises a material which has a coefficient of friction less than that of the material of resilient seal forming means 11. Teflon provides an entirely satisfactory low friction layer 13 which can be adhered to or bonded to 11. Low friction surface 13 is utilized to minimize damage to the magnetizable imaging member by decreasing the sliding friction. Resilient means 11 and surface 13 can be fabricated into a single member such as a flexible Teflon member and molded plastics with low friction surfaces can also be used.

The embodiments depicted in FIGS. 1 and 2 are particularly suited for magnetic development of latent magnetic images because magnetic imaging systems are capable of being run at high speeds such as 100 inches or greater and the magnetic developer material comprises only toner and not the relatively heavier carrier typically found in xerographic development. The combination of high speeds and small, light weight magnetic toner particles typically produces powder clouds of airborne toner which cause contamination of the machine and a general increase in the amount of undesired toner residing on background areas of finished hard copy. When the present invention is to be employed in high speed magnetic printing engines, it is particularly preferred to remove the airborne toner prior to its departure from the vicinity of the developing apparatus. As shown in FIGS. 1 and 2, this can be conveniently achieved in the present invention by locating baffles 10 above the development zone and adapting of baffles 10 to direct toner back into the toner supply chamber. While several baffle locations and designs can be employed in a perfectly satisfactory manner, FIG. 1 depicts baffles 10 extending through slots in wall 9. Airborne toner is diverted by baffles 10 from a region between the magnetizable imaging member, deformable seal forming means 11, and wall 9 through slots in wall 9 and back into the toner supply chamber. To minimize the formation of powder clouds of airborne toner, baffles 12 are mounted on wall 20 on the side of wall 20 facing the magnetizable imaging member. Baffles 12 may take any effective shape and it has been found that simple bars (shown in FIG. 2) having a height which precludes contact with the surface of the magnetizable imaging member when layer 13 is in engagement therewith will perform satisfactorily in reducing the formation of powder clouds of airborne toner.

Figure 5:
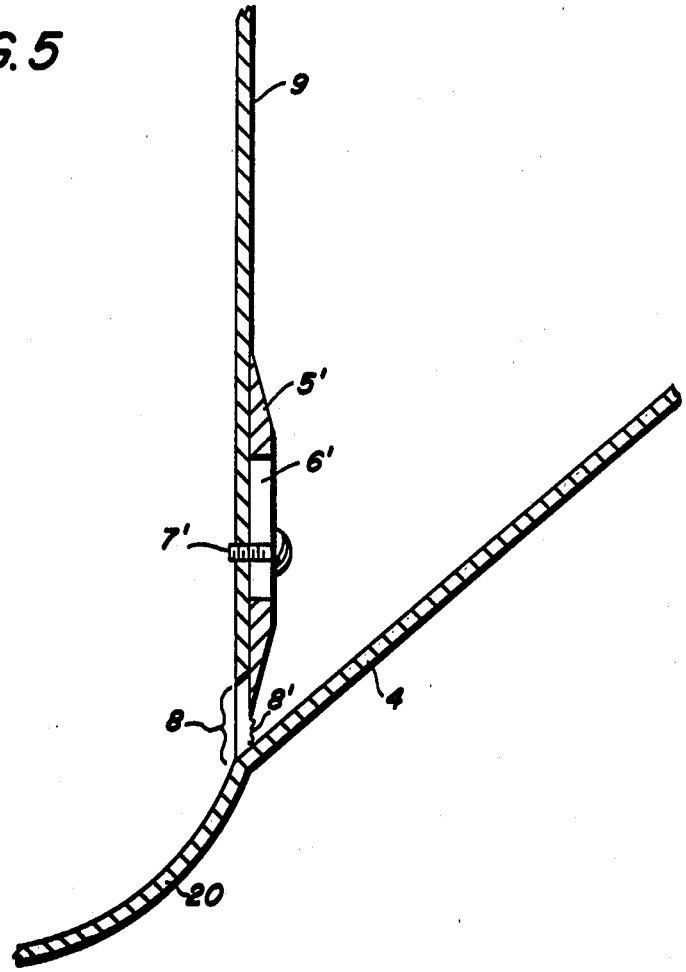

As toner is poured through opening 30 into the toner supply chamber, it passes through opening 8 into the space defined by the magnetizable imaging member in contact with layer 13, deformable seal forming means 11 and the top of opening 8. Metering plate 5 can be adjusted so that the magnetic toner replenishment rate from the magnetic toner supply chamber into the development zone just equals the depletion of magnetic toner from the development zone. The height of the developer zone is automatically maintained by toner in the supply chamber. While FIG. 1 shows plate 5 operatively connected to wall 4 to thus act as a metering plate, plate 5 could be operatively connected to wall 9 to act as a development zone adjustment plate by effectively extending the terminal portion of wall 9 (top most portion of opening 8) selectively and variably closer to or further away from wall 20. Since the primary height of the development zone is determined by the uppermost portion of opening 8, the height of the developer zone A can be effectively controlled to compensate for the magnetic field strength emanating from the latent magnetic image on the magnetizable imaging member. This is depicted in FIG. 5, wherein like numerals refer to like components of FIG. 1. In FIG. 5, it can be seen how developer zone height adjusting plate 5' defines an opening 8' which is different than opening 8 depicted in FIG. 1. In FIG. 5, the developer zone height will correspond to the uppermost portion of opening 8'.

Figure 3:
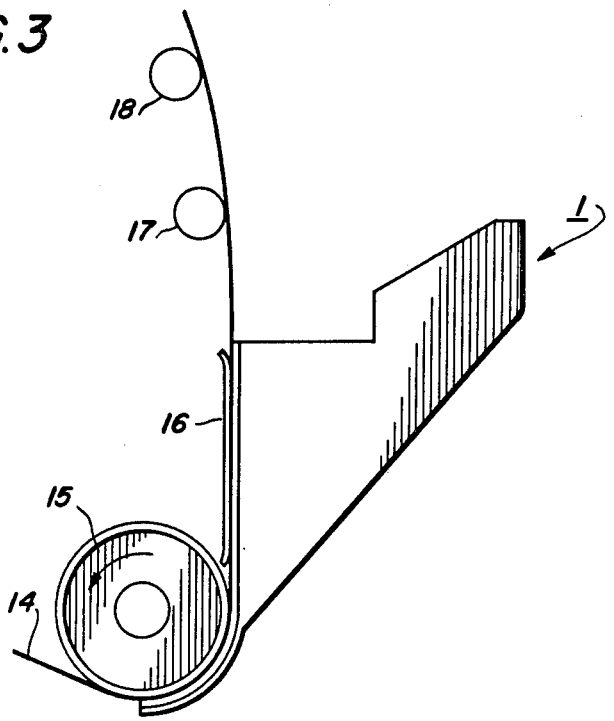
FIG. 3 is a schematic illustration of the embodiment depicted in FIG. 1 employed with a magnetic imaging tape.

FIG. 3 schematically illustrates the employment of the embodiment of FIGS. 1 and 2 or FIG. 5 to develop a latent magnetic image residing on a magnetic web or magnetic tape 14. The predetermined portion of the path of travel taken by magnetic tape 14 selected for the developer station (i.e., that portion of the path of travel of tape 14 along which the developer zone A is to be located) in an arcuate path about roller 15. The path of travel of tape 14 as depicted in FIG. 3, comes into the developer zone from the left, is routed about roller 15, against a backing member 16, and diverted onto other process stations by idler rollers 17 and 18. Tape 14 can be utilized in the form of an endless loop or can be utilized in association with supply and takeup reels. The significant point to be noted in FIG. 3 is that the wall portion of the developer housing which extends below the toner supply chamber and enters into defining the developer zone is made very small and performs in an entirely satisfactory manner. Yet, the amount of toner present in the toner supply toner of the tank development system of the present invention is many times greater than that contained in the development zone, allowing automatic replenishment of toner in the development zone and the development of numerous latent magnetic images.

Figure 4:
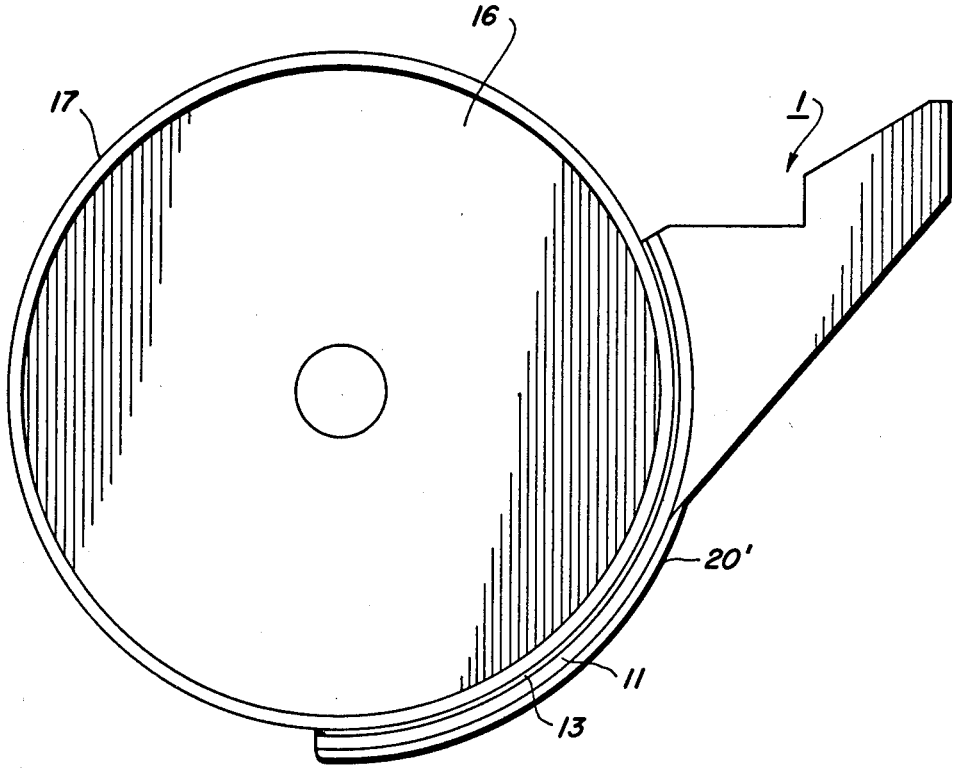
FIG. 4 is a schematic illustration of another embodiment of the present invention suitable for use with an imaging member mounted around a drum.

FIG. 4 schematically illustrates the utilization of another embodiment of the present invention in connection with magnetically developing a latent magnetic image which resides on a magnetizable imaging member formed along or wrapped around a drum surface. Magnetizable imaging member 17 is formed along or wrapped around the surface of drum 16 in FIG. 4. Developer housing 1 is essentially the same as that depicted in FIGS. 1–3 and 5 but shows a longer wall portion 20' as an illustration of permissible variations in accordance with the spirit of the present invention which allow the creation of a developer zone around any predetermined portion of a path of travel of a magnetizable imaging member.

Other modifications and variations will become apparent to those skilled in the art upon a reading of the present disclosure. These are intended to be within the scope of the present invention.

What is claimed is:

1. A tank developing system for developing latent magnetic images on magnetizable imaging members with magnetic toner, comprising: a developer housing having formed therein a chamber for the storage of magnetic toner, a wall member of said housing extending below said chamber; an opening in said housing in communication with said chamber; the wall member below said chamber being shaped to conform to a predetermined path of travel of a magnetizable imaging member; means for selectively varying the size of said opening; baffle means for removing airborne toner from the vicinity of the magnetizable imaging member and located above said opening; and resilient seal forming means affixed to said one wall on the side thereof opposite said chamber and adapted to contain toner between said one wall, said resilient seal forming means and said magnetizable imaging member along said predetermined path of travel.

2. The tank developing system of claim 1 wherein said material affixed to said resilient seal forming means further comprises material affixed to said resilient seal forming means along the portions thereof engageable with said imaging member and having a coefficient of friction less than said resilient seal forming means.

3. The tank developing system of claim 1 wherein said means for selectively varying the size of said opening comprises a plate slideably mounted upon the bottom wall of said chamber.

4. The tank developing system of claim 2 wherein said material affixed to said resilient seal forming means comprises tetrafluoroethylene fluorocarbon resin.

* * * * *